United States Patent [19]

Schoerner

[11] 4,452,302

[45] Jun. 5, 1984

[54] HEAT EXCHANGER WITH POLYMERIC-COVERED COOLING SURFACES AND CRYSTALLIZATION METHOD

[75] Inventor: William S. Schoerner, Plainfield, Ill.

[73] Assignee: Chicago Bridge & Iron Company, Oak Brook, Ill.

[21] Appl. No.: 262,528

[22] Filed: May 11, 1981

[51] Int. Cl.[3] ..... F28F 19/02; B01D 9/04

[52] U.S. Cl. ..... 165/133; 62/123; 62/532

[58] Field of Search ..... 165/133; 62/123, 124, 62/532, 592; 422/245, 241; 427/386, 388.2, 388.3; 138/97, DIG. 3

[56] References Cited

U.S. PATENT DOCUMENTS

| | | | |
|---|---|---|---|
| 2,718,279 | 9/1955 | Kraus | 55/71 |
| 2,828,236 | 3/1958 | Paterson | 138/DIG. 0.003 |
| 2,923,640 | 2/1960 | Buckingham | 165/133 |
| 3,265,124 | 8/1966 | Reys | 165/133 |
| 3,314,473 | 7/1965 | Smith et al. | 165/133 |
| 3,417,786 | 12/1968 | Schnabel | 138/97 |
| 3,489,209 | 1/1970 | Johnson | 165/133 |
| 4,143,524 | 3/1979 | Thijssen | 62/532 X |
| 4,162,617 | 7/1979 | Schmidt et al. | 62/123 |
| 4,296,612 | 10/1981 | Allo | 62/123 |

FOREIGN PATENT DOCUMENTS

| | | | |
|---|---|---|---|
| 2846564 | 5/1980 | Fed. Rep. of Germany | 62/532 |
| 1193612 | 6/1970 | United Kingdom | 62/532 |

*Primary Examiner*—William R. Cline
*Assistant Examiner*—Edward P. Walker
*Attorney, Agent, or Firm*—Marshall, O'Toole, Gerstein, Murray & Bicknell

[57] ABSTRACT

An improved heat exchanger in which a liquid is cooled by contacting a surface to crystallize a component therefrom by indirect heat exchange with a fluid on the otherside of the surface, having a layer of a polymeric material, to which the crystallized component does not significantly adhere, on the surface which contacts the liquid, and with said layer being sufficiently thin for efficient heat transfer through the surface.

An improved method of crystallizing a component from a liquid by indirect heat exchange by passing the liquid into contact with a surface covered with a thin layer of a polymeric material to which the crystals do not substantially adhere, and cooled by a cooling fluid which is sufficiently cold to cool the liquid to a temperature low enough to form crystals as the liquid contacts the surface.

9 Claims, 7 Drawing Figures

HEAT EXCHANGER WITH POLYMERIC-COVERED COOLING SURFACES AND CRYSTALLIZATION METHOD

The Government has rights in this invention pursuant to Contract No. 14-34-0001-8555 awarded by the Office of Water Research and Technology of the U.S. Department of the Interior.

This invention relates to apparatus and methods for crystallizing a material, such as in concentrating a liquid containing dissolved or suspended solids by crystallizing the liquid carrier or solvent.

BACKGROUND OF THE INVENTION

Various freeze processes have been developed to produce potable water from seawater or brackish water; to concentrate fruit juices such as orange juice and grape juice, vegetable juices such as tomato juice, and coffee; and to separate dissolved or suspended salts from the liquid carrier. See, for example, the patents of Ashley et al U.S. Pat. No. 3,070,969; Ashley U.S. Pat. No. 3,477,241; Ashley U.S. Pat. No. 3,501,924; Ganiaris U.S. Pat No. 3,620,034; Johnson U.S. Pat. No. 3,664,145; and Ogman U.S. Pat. No. 4,091,635.

Many types of equipment and heat exchangers have been used in the described freeze processes, but shell and tube heat exchangers, although widely used for heat exchange, apparently have been used only on a limited basis as freeze exchangers.

A shell and tube heat exchanger has an array of tubes extending between and through two spaced apart tube sheets surrounded by a shell. The shell is provided with an inlet and an outlet so that a suitable heat exchange fluid can be circulated through the shell to cool or heat a fluid flowing through each tube.

Each end of the array of tubes can be left open, or exposed, for use in some processing operations. For other operations, one or both ends can be enclosed by a fluid retaining header or box, which may or may not have a removable cover or access port. When only one header is present it can be either a fluid inlet or fluid outlet header. When a header is positioned at each end, one header can be a fluid inlet while the other can be a fluid outlet. Such an arrangement is conventional for once-through or single pass heat exchangers. However, for split pass heat exchangers, one of the headers can be divided into separate inlet and outlet sections. The header at the other end can be used to conduct fluid exiting from the outlet end of one group of tubes to the inlet end of the other group of tubes. The fluid inlet and outlet headers, or portions thereof, are provided with suitable conduit means for supplying and removing fluid.

Although shell and tube heat exchangers are generally used to heat a fluid stream, they can be used for cooling such a stream. When used for cooling purposes, each tube outlet end can be left open or uncovered so that the effluent can exit without restriction into a suitable receptacle. Similarly, each tube inlet end can be left open and the fluid to be cooled fed to the tube by any suitable means. Thus, if a liquid is to be cooled, a weir can be provided around the tube sheet so that a pool of liquid is formed and flows into the open mouth of each tube. Of course, one or both ends of the tubes can communicate with a closed header.

Shell and tube heat exchangers of the described types can be used as freeze exchangers for producing ice from water, for producing fresh water from brackish water and seawater, for concentrating fruit and vegetable juices, and in industrial crystallization processes. As the liquid flows through each tube, it can be cooled enough to crystallize a solid from the liquid. Thus, by cooling seawater, ice is obtained which when separated, washed, and melted provides potable water. When a fruit or vegetable juice is similarly chilled, ice forms and is removed to provide a concentrated juice.

Heat exchangers of the described types can use any cooling fluid on the shell side to cool a liquid flowing through the tubes. The fluid can be fed through one end and removed through the other end of the heat exchanger in a substantially unidirectional flow. Some suitable cooling fluids are ethyleneglycol and vaporizing refrigerants like ammonia and the Freon type refrigerants.

One of the major problems in freeze concentrating a liquid mixture in a shell and tube freeze exchanger has been the deposition of frozen solvent (usually ice) or solute, on the freeze exchanger surfaces. Ice build-up is usually the result of one or more of the following: dull or rough surface; surface flaws; coating discontinuities; corners; edges; non-uniform wetting of surface; low brine concentration; high heat flux; excessive ice fraction; inadequate flow rae; and local cold spots. Buildup of a solid, such as ice, lowers heat transfer and reduces the efficiency of the apparatus. In addition, if buildup of ice or some other frozen solvent or solid continues it can plug the apparatus completely, making it necessary to shut down to thaw the frozen material. This is true whether tubes or other shaped structures define the passages through which the liquid flows, such as a plate heat exchanger. Accordingly, a need exists for improved heat exchangers which can be used over extended periods of time by avoiding formation of solids deposited on each passage wall. Also needed are novel methods of freeze concentrating liquids which avoid or minimize formation of solid deposits on the fluid passage walls.

SUMMARY OF THE INVENTION

According to the invention it has been found that a heat exchanger in which a liquid is cooled by contacting a surface to crystallize a component thereof by indirect heat exchange with a fluid on the otherside of the surface is improved by placing a layer of a polymeric material, to which the crystallized component does not significantly adhere, on the surface which contacts the liquid, and with said layer being sufficiently thin for efficient heat transfer through the surface.

More specifically, it has been found that a heat exchanger in which a liquid is cooled by flowing through one or more metal walled passages therein to crystallize a component therefrom by indirect heat exchange with a fluid in the heat exchanger, on the outside of the walled passages, can be improved by placing a layer of a polymeric material, to which a crystallized component does not significantly adhere, on the passage walls, and with said layer being sufficiently thin for efficient heat transfer through the passage walls.

The polymeric material layer can be a thin film bonded to the surface or passage walls by an adhesive or the polymeric layer can be polymerized in situ. The film, for example, can be about 0.001–0.0025 inch thick. The layer can also be a layer of paint and the paint binder can be the polymeric material.

Some polymeric materials which can be used in the invention are one or more polyester resins, polytetrafluoroethylene resins, polyethylene resins, polypropylene resins, nylon resins, polyacrylate resins, epoxy resins, polyurethane resins, phenolic resins, polychlorofluoroethylene resins, cellulose acetate resins, vinyl resins, amino resins, alkyd resins or silicone resins.

When ice crystals are formed, the polymeric material used should obviously be one to which ice does not adhere.

Even more specifically, the invention provides an improved heat exchanger having a plurality of spaced apart metal tubes penetrating two spaced apart tube sheets; a metal shell around the tube sheets and connected thereto; means to deliver a cooling fluid around the tubes inside of the shell between the tube sheets; means to deliver a liquid feed stream into an inlet header or feed box partially defined by one of the tube sheets; and a layer of a polymeric material, to which the crystallized component does not significantly adhere, on the tube internal wall, and with said layer being sufficiently thin for efficient heat transfer through the walls of the tubes.

The improved heat exchanger can have vertical tubes and the heat exchanger can be a falling film heat exchanger. Alternatively, the tubes can be horizontal with the heat exchanger tubes intended to be full of liquid during flow therethrough.

According to a second aspect of the invention there is provided an improved method of crystallizing a component of a liquid by indirect heat exchange which comprises passing the liquid into contact with a surface covered with a thin layer of a polymeric material to which the crystals do not substantially adhere, and cooled by a cooling fluid which is sufficiently cold to cool the solution to a temperature low enough to form crystals as the liquid contacts the surface.

More specifically, there is provided an improved method of crystallizing ice from water or an aqueous solution by indirect heat exchange by passing water or an aqueous solution through one or more metal walled passages, internally covered with a thin layer of a polymeric material to which ice crystals do not substantially adhere, and cooled externally by a cooling fluid which is sufficiently cold to cool the water or solution to a temperature low enough to form ice crystals as the water or solution flow through the passages. The passages can be about vertical and the water or aqueous solution can flow through the passages as a falling film. Alternatively, the passages can be about horizontal and the water or aqueous solution can fill the passages during flow therethrough.

The polymeric material used to coat the surface and the passage walls may be of the type and kind previously described above. In addition, the passages can be those present in a shell and tube heat exchanger.

DETAILED DESCRIPTION OF THE DRAWINGS

To the extent it is practical, the same or similar elements which are illustrated in the various views of the drawings will be identified by the same numbers.

Figure 1:
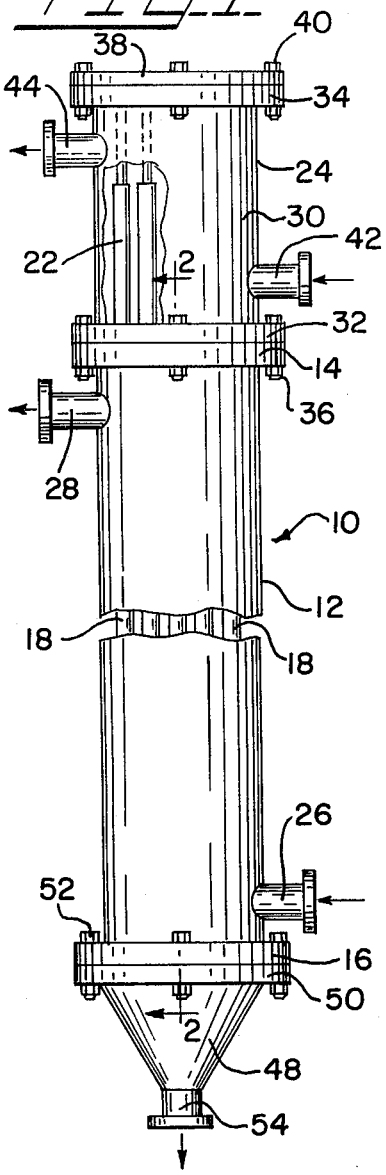
FIG. 1 is an elevational view of an improved falling film heat exchanger according to the invention.

With reference to FIG. 1, the vertical heat exchanger 10 has a circular cylindrical metal shell 12 having a top flange 14 and a bottom flange 16. A plurality of vertical tubes 18, generally of metal and of the same size, are positioned inside of shell 12. The lower end 20 (FIG. 2) of the tubes 18 extend slightly lower than the bottom flange 16. However, the upper ends 22 (FIG. 1) of tubes 18 extend upwardly into the header or feed box 24 mounted on the top of the heat exchanger 10. Inlet 26 near the bottom of shell 12 is used to deliver a heat exchange fluid to the shell side of the heat exchanger 10 and outlet 28 is used to remove the heat exchanger fluid therefrom.

Feed box 24 has a circular cylindrical body 30 to which lower flange 32 and upper flange 34 are joined. Lower flange 32 is removably secured to shell flange 14 by bolts 36. Cover 38 is removably attached to header or feed box upper flange 34 by bolts 40. A liquid to be processed in the heat exchanger 10 is supplied to header or feed box 24 by feed inlet 42. The excess feed, if any, can be removed by feed outlet 44 and then be recirculated to inlet 42.

A conical reducer 48 having flange 50 is removably connected to shell bottom flange 16 by bolts 52. Liquid flowing out of the lower ends 20 of tubes 18 is directed by conical reducer 48 to outlet 54 for delivery to a predetermined destination.

Figure 2:
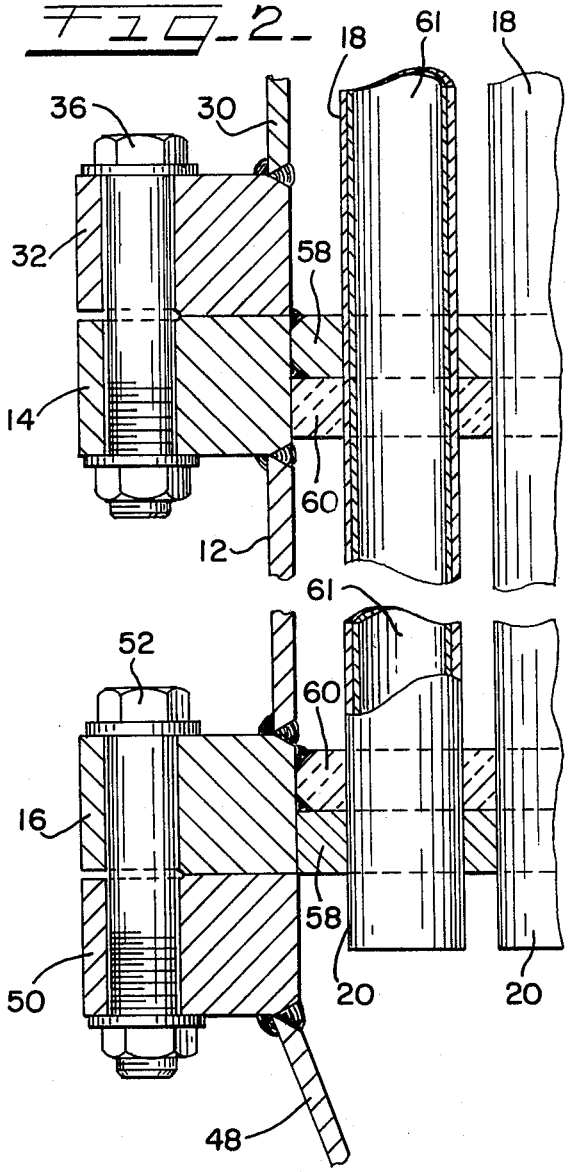
FIG. 2 is a sectional view taken along the line 2—2 of FIG. 1 and illustrates the top and bottom tube sheets.

FIG. 2 illustrates the top and bottom tube sheets in the heat exchanger 10. Each has a metal tube sheet 58 and an optional insulating layer 60.

The inside of each tube 18 is lined with a thin polyester film 61, such as a film of MYLAR about 0.001–0.002 inch thick, secured in place by a suitable adhesive.

Figure 4:
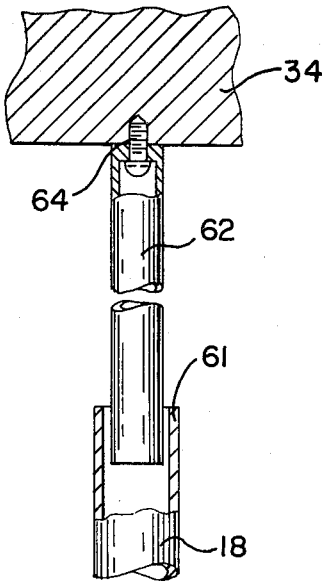
FIG. 4 is an elevational view, partly in section, illustrating an insert positioned in a tube mouth to regulate liquid flow into the tube.

As shown in FIG. 4, liquid flow into the top of the tubes 18 can be controlled to provide a uniform falling film by tubular inserts 62 which telescope into the top portion of tubes 18 for a short distance. Tubular inserts 62 are fastened to the lower surface of flange 34 by machine bolts 64.

The interior falling film freeze exchanger illustrated by FIGS. 1 to 4 can be used to concentrate a wide variety of liquid feed streams, including fruit juices, vegetable juices, seawater and brackish water.

A feed stream, usually aqueous, is introduced into header or feed box 24 by feed inlet 42. The liquid level in header or feed box 24 rises until the liquid flows over the top edge of tubes 18 and down the tubes between tubular inserts 62. The inserts 62 level out flow through the tubes 18 so that each tube receives a uniform supply of liquid. The volume of feed stream supplied by inlet 42 is generally slightly in excess of that which can flow per unit of time through tubes 18. The excess feed stream is withdrawn by feed outlet 44 and it can be redirected into the feed stream by suitable conduit means not shown.

A cooling fluid is introduced into the freeze exchanger by inlet 26 and it is removed by outlet 28. The cooling fluid may be a refrigerant gas such as ammonia, or a Freon gas such as dichlorodifluoroethane, or it may be a cooled liquid such as ethylene glycol or ethanol.

As the liquid feed flows downwardly in tubes 18 as a thin film on the walls of the tubes, the liquid becomes cooled and, if water, part of the water freezes into ice crystals. The liquid feed containing ice crystals flows out of the bottom of tubes 18 into a suitable receptacle not shown. The liquid feed can then be returned to the freeze exchanger to produce more ice. The ice crystals can ultimately be separated from the liquid and either be discarded or utilized depending on the purpose for which the liquid is concentrated. For example, if seawater is concentrated the ice slurry is recovered, washed and melted to obtain potable water. However, if orange juice is being concentrated the washed and melted ice is discarded.

Figure 5:
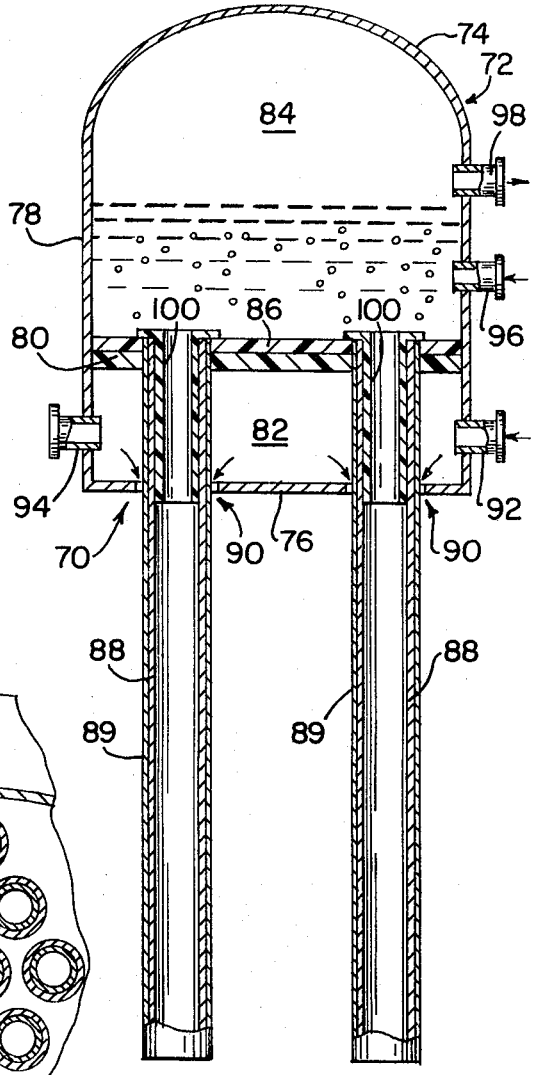
FIG. 5 is a vertical sectional view of one embodiment of an exterior falling film freeze exchanger provided by the invention.
Figure 3:
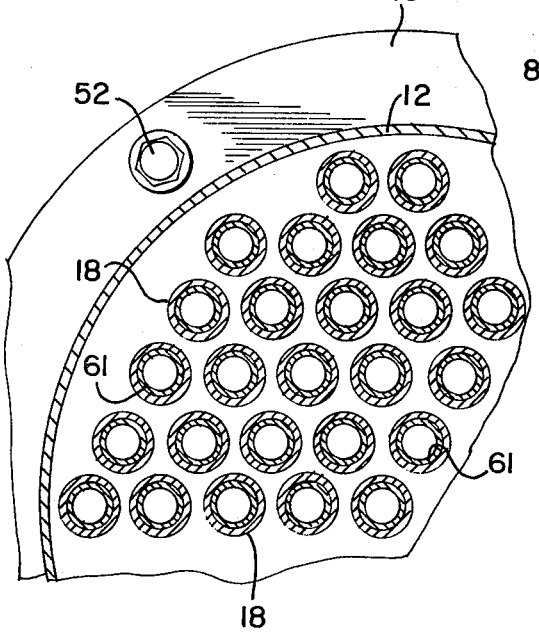
FIG. 3 is an enlarged view of the tube arrangement in the heat exchanger shown in FIGS. 1 and 2.

FIG. 5 illustrates an exterior falling film freeze exchanger 70. The freeze exchanger 70 includes a vessel 72 having a top 74, bottom 76, and side wall 78. Tube sheet 80 divides the vessel 72 interior into a liquid header or feed box space 82 in the bottom portion and a cooling fluid space 84 in the top portion. A layer of insulation 86, such as closed cell polyvinyl chloride foam, is bonded to the top surface of tube sheet 80.

A plurality of tubes 88, joined near their top ends to tube sheet 80, extend downwardly through oversized holes 90 in the vessel bottom 76. Each tube 88 is externally covered with a layer of epoxy paint 89 to which crystals, formed by heat exchange in the tubes, do not adhere. The clearance between holes 90 and tubes 88 provides space through which a film of feed liquid flows from header or feed box 82 downwardly along the exterior surface of tubes 88. The bottom end of each freeze tube 88 is closed. Liquid feed is supplied to header or feed box 82 by conduit 92 and the excess liquid is removed therefrom by conduit 94 and recycled by means not shown.

A cooling fluid, desirably a liquefied refrigerant gas such as Freon, is fed to the cooling fluid space 84 by conduit 96 and the resulting vapor is withdrawn by conduit 98. Inserts or liners 100, made of a low heat conductance material, are placed in the upper portion of freeze tubes 88 to prevent ice from forming on the freeze tube portions inside the header or feed box.

As the film of liquid feed flows downwardly on the exterior surface of freeze tubes 88 it is cooled by heat exchange with liquid refrigerant in the tubes. Ice crystals form in the liquid film and grow as it flows downwardly on the tubes and then off the end to fall into a receiving tank not shown. The ice slurry can be separated from the concentrated liquid and be either used or discarded depending on the desired product from the concentration. The liquid can be recycled to header or feed box 82 for further concentration.

Figure 6:
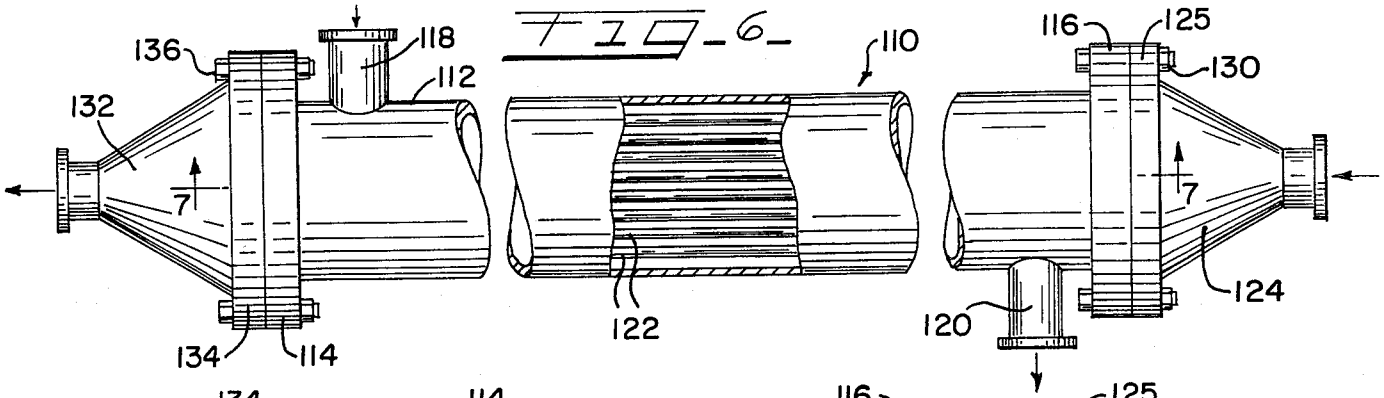
FIG. 6 is a side elevational view of a horizontal heat exchanger according to the invention.
Figure 7:
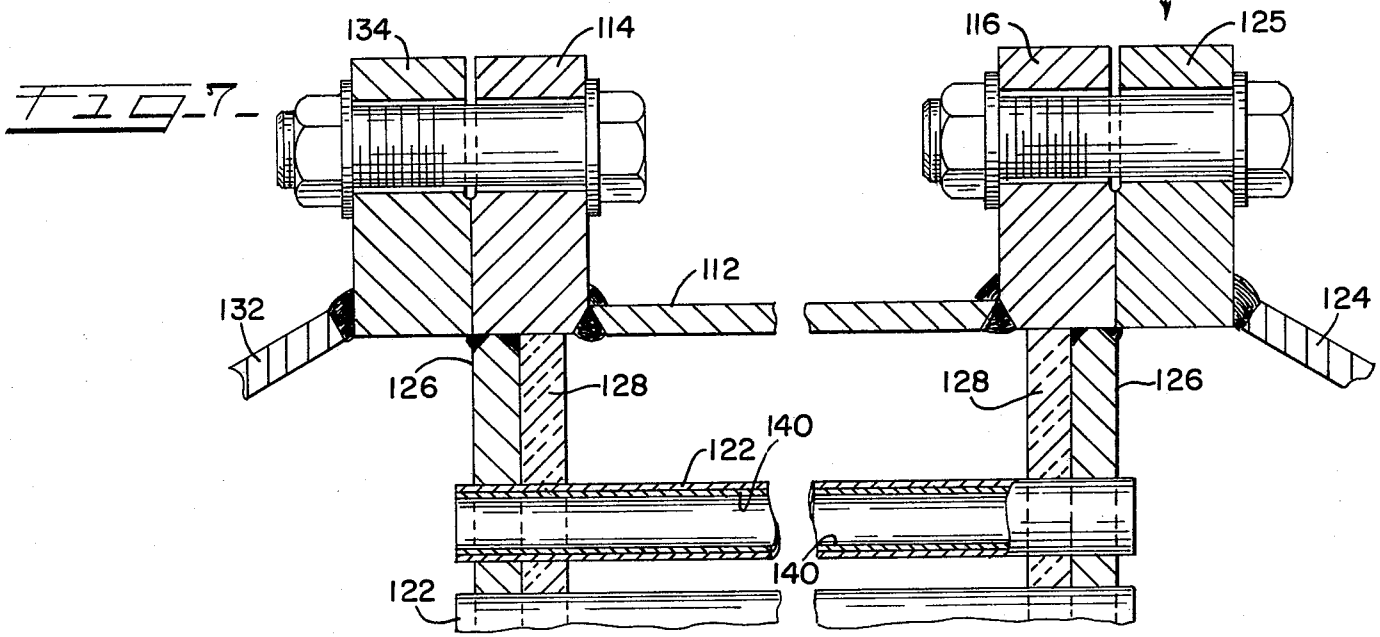
FIG. 7 is a sectional view taken along the line 7—7 of FIG. 6 and illustrates the tube sheet construction at each end of the heat exchanger.

FIGS. 6 and 7 illustrate the invention as applied to a horizontal heat exahnger. The horizontal heat exchanger 110 has a circular cylindrical shell 112 with a flange 114 at one end and a flange 116 at the other end. Inlet 118 feeds a heat exchange fluid to the shell side of the heat exchanger and the heat exchanger fluid is removed by outlet 120. A plurality of tubes 122 is axially located in shell 112 and the tube ends are supported by tube sheets 126 with a layer of insulation 128 on the inside.

The inlet end of the heat exchanger includes a conical member 124 having a flange 125 which is removably connected by bolts 130 to flange 116. Similarly, the outlet end of the heat exchanger has a conical member 132 having flange 134 which is removably joined by bolts 136 to flange 114.

The inside surface of the tubes 122 is coated with a layer of epoxy resin 140 polymerized in place.

The heat exchanger illustrated by FIGS. 6 and 7 is used by passing a liquid through tubes 122 at a rate which insures that the tubes will be completely full of liquid so as to obtain maximum indirect heat exchange through the metal tubes with the cooling fluid circulating on the shell side of the tubes. Because of the coating on the inside of the tubes, crystals which form in the liquid do not adhere and cling to the inside of the tubes and thus no obstructing deposit is formed which would otherwise require, perhaps, dismantling of the heat exchanger or at least a thorough cleaning or defrosting.

The foregoing detailed description has been given for clearness of understanding only, and no unnecessary limitations should be understood therefrom as modifications will be obvious to those skilled in the art.

What is claimed is:

1. An improved falling film heat exchanger for concentrating an aqueous liquid feed stream by crystallizing ice therefrom by indirect heat exchange comprising:

a plurality of spaced apart vertical metal tubes penetrating two vertically spaced apart upper and lower horizontal tube sheets;

a metal shell around the tube sheets and connected thereto;

means to deliver a cooling fluid around the tubes inside of the shell between the tube sheets;

means to deliver an aqueous liquid feed stream into a feed box partially defined by the upper tube sheet so that the liquid flows down the tubes as a falling film;

a layer of a polymeric material, to which ice crystals do not significantly adhere, on each tube internal wall, and with said layer being sufficiently thin for efficient heat transfer from the falling film through the polymeric layer and the tube wall; and means to withdraw a mixture of aqueous liquid containing ice crystals from the bottom end of the tubes and recycle the mixture to the top of the tubes to flow down the tubes as a falling film, so as to produce an ice slurry.

2. An improved heat exchanger according to claim 1 in which the polymeric material layer is a thin film bonded to the tube internal walls by an adhesive.

3. An improved heat exchanger according to claim 1 in which the polymeric material layer is polymerized in situ.

4. An improved heat exchanger according to claim 1 in which the layer is a layer of paint and the polymeric material is the paint binder.

5. An improved heat exchanger according to claim 1 in which the polymeric material is a polyester resin, a polytetrafluoroethylene resin, a polyethylene resin, a polypropylene resin, a nylon resin, a polyacrylate resin, an epoxy resin, a polyurethane resin, a phenolic resin, a polychlorofluorethylene resin, a cellulose acetate resin, a vinyl resin, an amino resin, an alkyd resin or a silicone resin.

6. An improved method of concentrating an aqueous liquid feed stream by crystallizing ice therefrom by indirect heat exchange which comprises:

feeding an aqueous liquid feed stream as a falling film into the tubes of a shell and tube heat exchanger in which the tube internal walls are covered with a layer of polymeric material to which ice crystals do not significantly adhere, with said layer being sufficiently thin for efficient heat transfer through the polymeric layer and the tubes;

said heat exchanger having a plurality of spaced apart vertical metal tubes, having top and bottom ends, penetrating two spaced apart tube sheets; a metal shell around the tube sheets and connected thereto; means to deliver a cooling fluid, around the tubes, inside of the shell between the tube sheets; and means to deliver the aqueous liquid feed stream to the top of the tubes;

withdrawing a mixture of aqueous liquid containing ice crystals from the bottom end of the tubes and recycling the mixture to the top of the tubes to flow down the tubes as a falling film; and continuing said method until an ice slurry is produced.

7. The improved method according to claim 6 in which the polymeric material layer is a thin film bonded to the tube internal walls by an adhesive.

8. An improved method according to claim 6 in which the polymeric material layer is polymerized in situ.

9. An improved method according to claim 6 in which the layer is a layer of paint and the polymeric material is the paint binder.

* * * * *

UNITED STATES PATENT AND TRADEMARK OFFICE

CERTIFICATE OF CORRECTION

PATENT NO. : 4,452,302

DATED : June 5, 1984

INVENTOR(S) : WILLIAM S. SCHOERNER

It is certified that error appears in the above-identified patent and that said Letters Patent are hereby corrected as shown below:

Column 2, line 26, change "rae" to --rate--; column 3, line 47, change "flow" to --flows--; column 5, line 62, change "exahnger" to --exchanger--.

Signed and Sealed this

Ninth Day of October 1984

[SEAL]

*Attest:*

*Attesting Officer*

GERALD J. MOSSINGHOFF

*Commissioner of Patents and Trademarks*